US011470953B2

(12) United States Patent
Walther

(10) Patent No.: US 11,470,953 B2
(45) **Date of Patent: *Oct. 18, 2022**

(54) PINCH GRIP TOOTHBRUSH HANDLE

(71) Applicant: F.T.G.G. LLC, Apex, NC (US)

(72) Inventor: Steven Karl Walther, Apex, NC (US)

(73) Assignee: F.T.G.G., LLC, Apex, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/190,560

(22) Filed: Mar. 3, 2021

(65) Prior Publication Data

US 2021/0204682 A1 Jul. 8, 2021

Related U.S. Application Data

(63) Continuation of application No. 16/534,638, filed on Aug. 7, 2019, now Pat. No. 10,966,511, which is a continuation of application No. 14/825,619, filed on Aug. 13, 2015, now Pat. No. 10,413,048, which is a continuation-in-part of application No. 14/189,327, filed on Feb. 25, 2014, now Pat. No. 9,138,048.

(60) Provisional application No. 61/772,945, filed on Mar. 5, 2013.

(51) Int. Cl.
*A46B 5/02* (2006.01)
*A46B 17/02* (2006.01)

(52) U.S. Cl.
CPC ..... *A46B 5/02* (2013.01); *A46B 17/02* (2013.01); *A46B 2200/1066* (2013.01)

(58) Field of Classification Search
CPC ..... A46B 17/02; A46B 5/002
See application file for complete search history.

(56) References Cited

U.S. PATENT DOCUMENTS

| | | | | |
|---|---|---|---|---|
| 3,067,446 | A * | 12/1962 | McGauley | A46B 5/02 16/DIG. 12 |
| 3,103,027 | A | 9/1963 | Birch | |
| 3,465,751 | A | 9/1969 | Powers | |
| 4,288,883 | A | 9/1981 | Dolinsky | |
| D273,538 | S | 4/1984 | Fames et al. | |
| 4,488,327 | A | 12/1984 | Snider | |
| 4,610,045 | A | 9/1986 | Rauch | |
| 4,766,633 | A | 8/1988 | Clark | |

(Continued)

FOREIGN PATENT DOCUMENTS

EP 2 554 353 2/2013

OTHER PUBLICATIONS

Non-Final Office Action dated Feb. 20, 2015 of U.S. Appl. No. 14/189,327.

*Primary Examiner* — Michael D Jennings
(74) *Attorney, Agent, or Firm* — Nixon & Vanderhye, P.C.

(57) ABSTRACT

A toothbrush with a pinch grip toothbrush handle facilitates a healthier brushing technique by encouraging the use of a pinch grip. A pinch grip handle with one or more finger grooves encourages the use of a pinch grip, thereby reducing the amount of pressure a user can apply during brushing at any brushing orientation. A finger groove may be contoured, consisting of concave surface areas and optionally convex surface areas. A handle may feature a pair of finger grooves that resemble a peanut or hour glass shape, which encourages the use of a pinch grip. Embodiments may take the form of a supplemental attachment to a toothbrush, or an integral part of a solid single-piece toothbrush.

17 Claims, 13 Drawing Sheets

(56) References Cited

U.S. PATENT DOCUMENTS

| | | | | |
|---|---|---|---|---|
| 5,201,092 | A | 4/1993 | Colson | |
| 5,342,284 | A | 8/1994 | Lemon | |
| D350,440 | S | 9/1994 | Christian | |
| 5,926,899 | A | 7/1999 | Scott | |
| 6,205,611 | B1 | 3/2001 | Vigil | |
| D446,019 | S | 8/2001 | Hansen et al. | |
| 6,325,626 | B1 | 12/2001 | Blass | |
| 6,599,048 | B2 | 7/2003 | Kuo | |
| 6,952,856 | B2 | 10/2005 | Kalzuka | |
| 6,957,467 | B2 | 10/2005 | Cabedo-Deslierres | |
| D555,359 | S | 11/2007 | Chen | |
| 7,383,603 | B2 | 6/2008 | Edwards | |
| 7,386,909 | B2 | 6/2008 | Hohlbien | |
| 8,079,106 | B2 | 12/2011 | Yang | |
| 9,138,048 | B2 * | 9/2015 | Walther | A46B 5/02 |
| 2005/0005380 | A1 | 1/2005 | Kwon | |
| 2005/0044647 | A1 | 3/2005 | Hohlbein | |
| 2007/0226931 | A1 | 10/2007 | Kayser | |
| 2008/0052845 | A1 | 3/2008 | Djang | |
| 2008/0131842 | A1 | 6/2008 | Edwards | |
| 2008/0196184 | A1 | 8/2008 | Dooley | |
| 2008/0216267 | A1 | 9/2008 | Chu | |
| 2009/0144921 | A1 | 6/2009 | Newsome | |
| 2010/0101031 | A1 | 4/2010 | Hodgkison | |
| 2011/0016651 | A1 | 1/2011 | Piserchio | |
| 2011/0136081 | A1 | 6/2011 | Micali | |
| 2012/0036663 | A1 | 2/2012 | Chen | |
| 2013/0305472 | A1 | 11/2013 | Hohlbein | |
| 2014/0137350 | A1 * | 5/2014 | Wen | A46B 9/04 15/143.1 |
| 2014/0137353 | A1 * | 5/2014 | Wen | B29C 49/20 264/209.3 |
| 2014/0217807 | A1 * | 8/2014 | Kayser | A46B 5/0079 300/21 |
| 2014/0352719 | A1 | 12/2014 | Tran | |

* cited by examiner

PINCH GRIP TOOTHBRUSH HANDLE

CROSS REFERENCE TO RELATED APPLICATIONS

This application is a continuation of Ser. No. 16/534,638, filed Aug. 7, 2019, which is a continuation of Ser. No. 14/825,619, filed Aug. 13, 2015, as U.S. Pat. No. 10,413,048, issued on Sep. 17, 2019, which is a continuation in part of U.S. application Ser. No. 14/189,327, filed Feb. 25, 2014, as U.S. Pat. No. 9,138,048, issued on Sep. 22, 2015, which claims the benefit of U.S. Provisional Application No. 61/772,945, filed Mar. 5, 2013, of which are hereby incorporated by reference in their entirety.

FIELD OF THE INVENTION

The present application relates to toothbrushes, and more specifically to toothbrush handles for use with a pinch grip.

BACKGROUND

Dental plaque—the accumulation of bacteria and food debris—does not require aggressive brushing to be removed; it is easily brushed away with gentle strokes. Commonly an individual will approach plaque like frost on a car window: the gums and teeth are attacked while the plaque is forcefully scraped away. This dental assault leads to increased temperature sensitivity, tooth pits along the gum line, and a disrupted smile because of cosmetic recession of the gum; together these changes are referred to as noncarious cervical lesions (NCCLs).

NCCLs were first observed in the 16th century shortly after the first toothbrushes. Five-hundred years later and now in the era of modern dentistry. NCCLs remain a common complaint of patients and a challenging foe for the dentist. Further, over the past century, the toothbrush has hardly changed; this can most easily be recognized with the lack of innovation for the handle of the toothbrush. A patient with a modem toothbrush continues to brush aggressively because they fail to address a critical cause of NCCLs, which is excessive force on the gums caused by the hand holding the toothbrush.

Currently, many users brush their teeth by applying a lot of pressure. This is due to the design and size of the toothbrush, as well as the desire to remove plaque from one's teeth. Contemporary toothbrushes accommodate a user's entire hand, and therefore encourage a power grip. For example, the surface area and length of contemporary toothbrush handles provide more than adequate space for an entire hand to grip the handle. Grasping the toothbrush with the entire hand increases the amount of force a user can exert on the toothbrush, which in turn leads to an increased pressure applied on the user's teeth and gums. As a result, the applied pressure may wear on the user's gums, causing NCCLs. Therefore, the gums may start to recede, and experience or undesirable symptoms.

Only two categories of contemporary toothbrush designs incorporate handles that do not naturally encourage a power grip, or a grip by the user's entire hand: travel toothbrushes and incarceration toothbrushes. Contemporary travel toothbrushes typically feature an upper half with a brush head, neck, and connection region, and a removable lower half that serves the two purposes. First, the lower half can be used as a cover sleeve for the upper half, encasing the brush head and neck during travel or storage. Second, the lower half may be used as a grip extension that connects to the connection region of the upper half. When connected, the surface area and length of the travel toothbrush provide more than adequate space for an entire hand to grip the handle, and therefore results in the deficiencies described above. Without the lower half, the upper half of the common travel toothbrush has insufficient surface area for a user to grasp and control the brush with enough force to effectively clean teeth.

Incarceration toothbrushes also have insufficient surface area for a user to grasp and control the brush with enough force to effectively clean teeth. These toothbrushes usually feature a handle that cannot be converted into a sharp weapon. For example, the handle may be a thin, circular area that provides enough surface area for grip by a user's index finger and thumb. As with the upper half of a travel toothbrush, the incarceration toothbrush is difficult to control and apply enough pressure to effectively clean teeth.

As can be seen, there is a need for a toothbrush that allows a user to limit and/or reduce the amount of potentially damaging pressure that is easily created when brushing with a power-grip, while enabling the body mechanics necessary for thorough brushing practices.

SUMMARY

Described herein are various embodiments of toothbrushes having a pinch grip handle. Some embodiments of a pinch grip toothbrush handle having contoured grooves that reduces the amount of pressure a user can apply while brushing, as it relates to the amount of pressure a user can apply while brushing with an instrument that has a handle designed to accommodate the grip of four or more fingers.

Proper brushing is paramount in having good oral health; however, proper brushing does not require a person to brush forcefully, in fact, it is the contrary to that. An important aspect of proper brushing is the amount of pressure placed on the teeth and gums. Brushing should be done with gentle pressure; as a matter of fact, a common recommendation given to brushers, to help achieve the desired pressure, is to hold a toothbrush with a two or three fingered grip, or a pinch grip.

When comparing the present approach to tooth flossing the connection becomes obvious. Flossing requires a person to have two anchor points, both of which are individual fingers. Using individual fingers as anchor points will allow the person to achieve the appropriate pressure needed for flossing. The present approach does not use the entire hand as an anchor point because doing so would most certainly allow the user to employ a power grip and generate more pressure than is healthy. This realization clearly demonstrates the benefit of a toothbrush with an anchor point, otherwise known as a handle, which is designed to discourage aggressive brushing.

Embodiments of a pinch grip toothbrush handle may include a distal region, a medial region, and a proximal region. The distal region may include a first distal end, a first medial portion, and a first proximal end. In some embodiments, the first medial portion may have a radial width greater than the first distal end and the first proximal end. The medial region may include a second distal end, a second medial portion, and a second proximal end; the second distal end connected to the first proximal end. In some embodiments, the second medial portion may have a radial width less than the second distal end and the second proximal end. The proximal region may include a third distal end, a third medial portion, and a third proximal end; the third distal end is connected to the second proximal end. In some embodiments, the third medial portion may have a radial width greater than the third distal and the third proximal end. Portions of the first proximal end, a second distal end, a second medial portion, and a second proximal end, and third distal end may define at least one finger groove. The finger groove may be configured to accommodate a target user class. In some embodiments, a finger groove may have an asymmetric curve shape with a vertex. The vertex of a finger groove may be closer to the proximal end of the handle than the distal end of the handle.

Some embodiments feature a plurality of finger grooves. For example, in some embodiments, a second portion of the first proximal end, a second distal end, a second medial portion, and a second proximal end, and third distal end define a second finger groove. Some embodiments feature a second finger groove that is located on the substantially opposite circumferential side of the handle from the at least one finger groove. In some embodiments, the second finger groove is located in a radially offset position relative to the at least one finger groove. A second finger groove may be located at substantially the same longitudinal position as the at least one finger groove in some embodiments, or at a different longitudinal position in other embodiments. In some embodiments, the distal, medial, and proximal regions may define a second finger groove that has an asymmetric curve shape with a vertex. This vertex may be closer to the proximal end of the handle than the distal end of the handle.

In some embodiments, a cross section of the medial region, perpendicular to the longitudinal axis of the handle, may have a width in a first direction that is greater than a width in a second direction.

The surface of at least one of the distal region, the medial region, and the proximal region, may be textured. Some embodiments include a stress-breaking feature, such that the pinch grip handle flexes at a fulcrum region when the applied force at a particular location exceeds a threshold value.

In some embodiments, the longitudinal length of the proximal region is about one-fifth to one-fourth of the longitudinal length of the pinch grip handle. In some embodiments, the longitudinal length of the medial region is about one-fifth to one-fourth of the pinch grip handle. In some embodiments, the longitudinal length of the distal region is about one-half to three-fifths of the handle. Some embodiments of a pinch grip handle may have a longitudinal length of about 3 cm to 6 cm.

To the accomplishment of the foregoing and related ends, certain illustrative embodiments of the present approach are described herein in connection with the following description and the annexed drawings. These embodiments are indicative, however, of but a few of the various ways in which the principles of the present approach may be employed, and the present approach is intended to include all such aspects and their equivalents. Other advantages, embodiments and novel features of the invention may become apparent from the following description when considered in conjunction with the drawings. The following description is given by way of example, but not intended to limit the invention solely to the specific embodiments described, which can be understood in conjunction with the materials that follow

DETAILED DESCRIPTION

The following detailed description is of the best currently contemplated modes of carrying out exemplary embodiments of the invention. The description is not to be taken in a limiting sense, and is made merely for the purpose of illustrating the general principles of the invention, as the scope of the invention is best defined by the appended claims.

Described herein are embodiments of a toothbrush that encourage the use of a pinch grip. A pinch grip is a type of grip in which one presses the thumb against the fingers of the hand, and generally does not involve the palm. There are three general types of pinch grips. A tip pinch uses only the tips of the fingers and thumb, such as when holding a small diamond. A chuck pinch, which is a common grip for a pen or pencil, uses the thumb and first two fingers. A lateral pinch involves the thumb and a side of the first finger, such as when holding a key. In contrast, a power grip is where the hand wraps completely around an object, such as a handle, with the object is more or less parallel to the knuckles, and usually protrudes from one side or both sides of the hand. A pinch grip generates about 10%-30% the amount of force generated with a power grip, and provides more control than a power grip. The increased control is due to the role of the thumb, which can move about several degrees of freedom in a precise manner. In contrast, the power grip provides less control and accuracy because the fingers together in a limited direction (wrist flexion).

Figure 1:
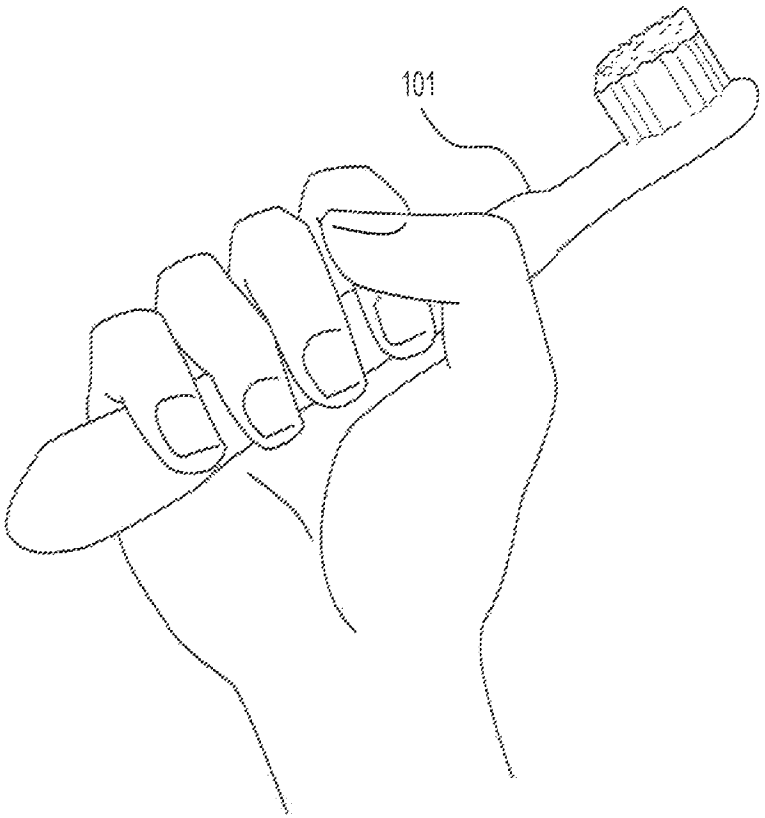
FIG. 1 shows an example of a power grip applied to a toothbrush.

FIG. 1 shows a power grip used to hold contemporary toothbrush 101. As can be seen, the hand forms a cylindrical grip about the handle of contemporary toothbrush 101, in which the fingers curl around the handle from one direction (e.g., clockwise if viewed looking at the long axis of the handle from the bottom), and the thumb curls around the handle from the opposite direction (e.g., counterclockwise from the same view). In the power grip, the handle of contemporary toothbrush 101 rests against not only the fingers, but also against the metacarpophalangeal joint pads and other surfaces of the palm. The power grip shown in FIG. 1 allows the user of toothbrush 101 to exert a significant amount of force on the brush. Even at modest power grip forces, the force exerted typically exceeds the threshold pressure that most people's gums can sustain, causing gum recession and other undesirable symptoms.

Figure 2:
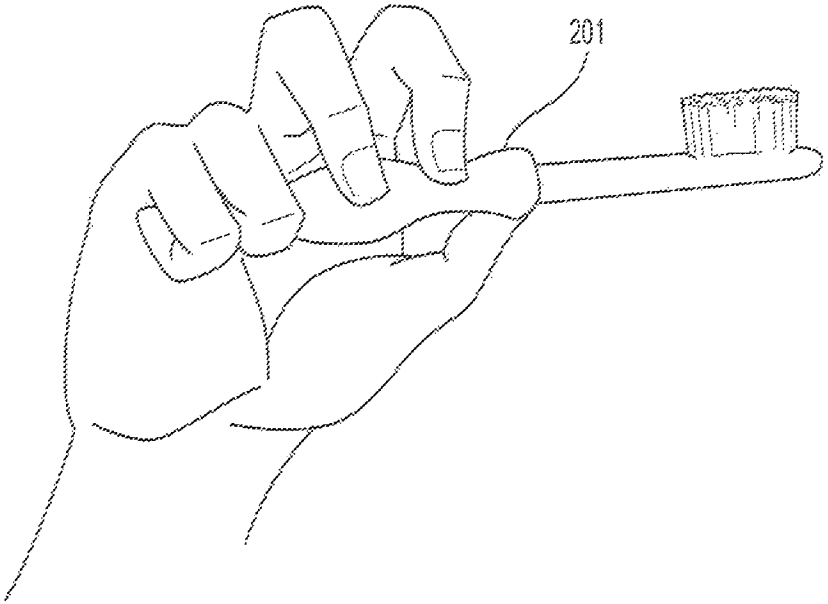
FIG. 2 shows an example of a pinch grip applied to a toothbrush.

FIG. 2 shows a pinch grip used to hold an embodiment of a pinch grip handle toothbrush 201. In this embodiment, pinch grip handle toothbrush 201 has an abbreviated handle that terminates at the distal end of the distal region, as those elements are described below. As can be seen, the thumb and index finger contact the finger grooves in the distal, medial, and proximal regions of the handle, forming a chuck grip (a type of pinch grip). In some grasping positions, the middle finger may also contact a surface of the medial and distal regions. Because of the shape of the handle, pinch grip handle toothbrush 201 encourages users to employ a pinch grip when using the toothbrush. For example, the handle includes two bulbous regions connecting to a medial region, forming at least one finger groove. The finger groove provides a natural contact surface for at least one finger, and in some embodiments, an additional finger groove provides a natural contact surface for a thumb. Some finger grooves provide contact space for additional fingers, such as along the medial and distal regions described below. Overall, the shape encourages the user to employ a pinch grip instead of a power grip—even in handles that extend beyond the width of the user's hand. As a result, the maximum force applied during brushing is significantly lower—on the order of 10%-30%—than with a power grip.

A toothbrush with a pinch grip handle comprising at least one finger groove allows a user to apply sufficient pressure to clean teeth, but limits the amount of pressure to reduce or prevent damage to the user's gums. One embodiment of a pinch grip toothbrush handle comprises at least two finger grooves, such that a first finger groove is located on the generally opposite side of the long axis of the handle from a second finger groove. In such embodiments, one finger groove may provide a contact surface for the thumb, and the other finger groove may provide a contact surface for at least the index finger. In another embodiment, the first finger groove is located on the substantially opposite side of the handle, e.g., the bottom or posterior plain, from a second finger groove.

For example, the first finger groove may be located on a top (superior) side of the handle, and the second finger groove may be located on a bottom (posterior) side of the handle, relative to the toothbrush head. As another example, the first finger groove may be located on a left side of the handle, and the second finger groove may be located on the right side of the handle. In some embodiments, a first finger groove is located on the handle in a radially offset position from a second finger groove. For example, the first finger groove may be located on a top side of the handle, and the second finger groove may be located on a right side of the handle. As another example, and looking down the long-axis of the handle from the distal end toward the proximal end, the first finger groove may be located at a position that resembles the area from 11:00 o'clock to 1:00 o'clock, and the second finger groove may be located at a position that resembles the area between 2:00 o'clock and 4:00 o'clock. Those positions are given as examples only, and the relative locations of the finger grooves may vary, as well as the amount of area occupied by a finger groove using the clock analogy.

In some embodiments, a first finger groove is located on the handle at substantially the same longitudinal position as a second finger groove, i.e., at the generally same height if the handle is standing on its most distal end and the brush head is up. In other embodiments, a first finger groove may be located at a slightly different longitudinal position along the long axis of the handle, from a second finger groove. For example, a first finger groove may be located on the handle such that the first finger groove's midpoint is at the midpoint of a medial portion of the handle, and a second finger groove may be located on the handle such that the second finger groove's midpoint is between the midpoint of a medial portion of the handle and the most distal portion of the handle. In some embodiments, the position of an outermost edge of the first finger groove along the long axis of the handle overlaps the position of an outermost edge of the second finger groove.

The handle may have a non-uniform cross-sectional shape along its long axis. For example, a distal region may have a generally ovular cross section, a medial region may have a predominately rectangular cross section, and a proximal region may have a circular cross section.

In some embodiments, a pinch grip toothbrush handle is an integral part of a single piece toothbrush. In other embodiments, a pinch grip toothbrush handle is a removable attachment to an upper toothbrush mating portion. For example, the pinch grip toothbrush handle may be connected to an upper toothbrush mating portion by numerous means, including but not limited to: snapping the pinch grip toothbrush handle using, e.g., structural components configured to interlock, screwing the handle into the neck (or vice versa), sliding the handle over a length of the brush, to name a few methods.

A pinch grip handle may be designed to accommodate at least a two or three fingered pinch grip. The relative shapes of the proximal, medial, and distal regions, may be configured to provide adequate contact surface area for the desired number of fingers, for a given finger size. The index finger and thumb of the same hand may be used to grasp the handle by placing them on generally opposite sides of the handle and pinching down on the surface. The finger placement may be radially and/or longitudinally offset. Optionally, the middle finger of the same hand may be placed on the handle to provide a more secure and balanced grip of the handle. There are several possible finger positions that will allow the user to achieve a comfortable yet advantageous pinch grip.

By design, the present approach encourages the use of a pinch grip, and thereby provides a toothbrush handle that can limit the amount of pressure one can physically generate while brushing when holding a brushing device with a full handed power grip, and thereby encouraging healthy and proper bushing techniques.

Optionally, the handle may be outfitted with an arrangement of bumps, notches, and/or other forms of raised or depressed surface textures, or combinations of more than one form of textured surfaces, to increase surface friction and reduce the possibility that the pinch grip toothbrush handle slips during use.

Figure 3:
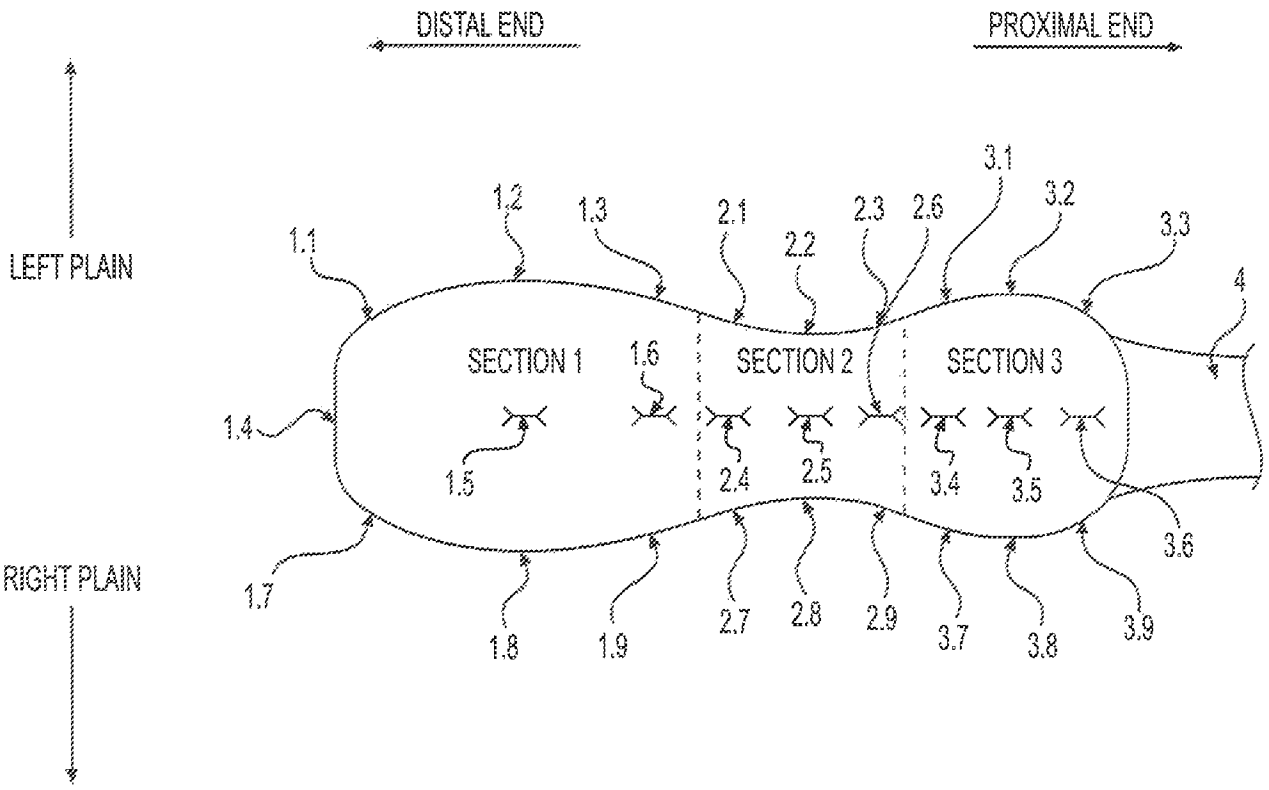
FIG. 3 is a top view schematic of an embodiment of a pinch grip toothbrush handle.

Referring now to the drawings, FIG. 3 illustrates an embodiment of a pinch grip toothbrush handle viewed from the top, such that the view shows the superior plain. The orientation of the toothbrush in FIG. 3 is such that the brush head (not shown) is at the proximal end, and the bristles of the brush are facing upward from the page. In this embodiment, the handle terminates at the distal end 1.4, but it should be appreciated that other embodiments may extend beyond the distal region. The embodiment shown features a distal region, a medial region, and a proximal region, wherein the distal and proximal regions are generally bulbous in shape and taper to form the medial region, as described in further detail below.

Distal region labelled Section 1 is the most distal end region of the pinch grip toothbrush handle embodiment shown in FIG. 3. In some embodiments, the distal region is generally bulbous, such that it has a width somewhere in the medial portion greater than the widths at the distal and proximal portions. This larger width does not need to be in the middle of the distal region, but in some embodiments may be at or near the middle. Also, the larger width from the left plain to the right plain, shown in FIG. 3 as from surface 1.2 to surface 1.8, may be different than the largest width from the superior plain 1.5 to the posterior plain 1.11 (see, e.g., FIG. 4A). In other words, the cross-sectional shape may be square, rectangular, circular, or ovalular. The cross-sectional shape may also change from the distal end 1.4 to the proximal portion 1.6.

In some embodiments, the distal region has the most girth and overall surface area relative to other regions described below. For example, in embodiments having a handle portion extending distally beyond the distal region (see, e.g., FIG. 10A, which includes a tail extending from the distal region), the distal region may be significantly larger (from about 2 to about 4 times the maximum width in a given direction, and generally about 2-3 times) than the proximal region to reduce the tendency to employ a power grip. Surface 1.1 is the most distal portion of the pinch grip toothbrush handle's left side in the view shown in FIG. 3, and in some embodiments may be tapered toward distal end 1.4. Surface 1.2 is the most medial portion on the left side of the distal region, and represents the axially outermost edge of the pinch grip toothbrush handle's distal region. Surface 1.3 is the most proximal portion on the left side of the distal region in the view shown in FIG. 3, and in some embodiments may be tapered toward the medial region labelled Section 2. Distal end 1.4 is the most distal portion of the handle. Surface 1.5 is the most medial portion on the superior plane of the distal region. Area 1.6 is the most proximal portion on the superior plane of the distal region. Surface 1.7 is the most distal portion of the handle's right side, and in some embodiments may be tapered toward distal end 1.4. Surface 1.8 is the most medial portion on the right side of the distal region, and represents the axially outermost edge of the pinch grip toothbrush handle's distal region. Surface 1.9 is the most proximal portion on the right side of the distal region in the view shown in FIG. 3, and in some embodiments may be tapered toward the medial region labelled Section 2.

Surfaces 1.2 and 1.8 may be located at the same position in the longitudinal direction. In some embodiments, surfaces 1.2 and 1.8 are located generally at the midpoint of the distal region in the longitudinal direction. In some embodiments, surfaces 1.2 and 1.8 are located between the midpoint of the distal region in the axial direction and the distal end 1.4; in other embodiments, surfaces 1.2 and 1.8 are located between the midpoint of the distal region in the axial direction and the proximal end of the pinch grip toothbrush handle. In alternative embodiments, surfaces 1.2 and 1.8 may be offset such that one surface is located closer to the distal end in the longitudinal direction than the other surface, thereby creating an asymmetrical profile in the distal region when viewed from above. In some embodiments, surfaces 1.2 and 1.8 are the axially outermost edges of any outer edge of the pinch grip toothbrush handle.

Section 2 is the medial region of the handle, and in the embodiment shown has the least amount of girth and surface area of the three regions. The relative dimensions of these regions create at least one finger groove, which as described herein promotes the advantageous use of a pinch grip. Surface 2.1 is the most distal portion on the left side of section 2, and in some embodiments may taper toward Surface 2.2. Surface 2.2 is the most medial portion on the left side of section 2. Surface 2.3 is the most proximal portion on the left side of section 2, and in some embodiments may taper toward Surface 2.2. Surface 2.4 is the most distal portion on the superior plane of section 2, and in some embodiments may taper toward Surface 2.5. Surface 2.5 is the most medial portion of the superior plane of section 2. Surface 2.6 is the most proximal portion on the superior plane of section 2 and in some embodiments may taper toward Surface 2.5. Surface 2.7 is the most distal portion on the right side of section 2, and in some embodiments may taper toward Surface 2.8. Surface 2.8 is the most medial portion on the right side of section 2. Surface 2.9 is the most proximal portion on the right side of section 2, and in some embodiments may taper toward Surface 2.8.

Section 3 is the most proximal region of the handle and has a girth and surface area that may be less than that of section 1 but greater than that of section 2. Surface 3.1 is the most distal portion on the left side of section 3, and in some embodiments may taper toward the medial region labelled Section 2. Surface 3.2 is the most medial portion on the left side of section 3. Surface 3.3 is the most proximal portion on the left side of section 3, and in some embodiments may taper toward the proximal end of the handle where it meets the shaft labelled 4. Surface 3.4 is the most distal portion on the superior plane of section 3, and in some embodiments may taper toward the medial region labelled Section 2. Surface 3.5 is the most medial portion on the superior plane of section 3. Surface 3.6 is the most proximal portion on the superior plane of section 3, and in some embodiments may taper toward the proximal end of the handle where it meets the shaft labelled 4. Surface 3.7 is the most distal portion on the right side of section 3, and in some embodiments may taper toward the medial region labelled Section 2. Surface 3.8 is the most medial portion on the right side of section 3. Surface 3.9 is the most proximal portion on the right side of section 3, and in some embodiments may taper toward the proximal end of the handle where it meets shaft 4.

Figure 4A:
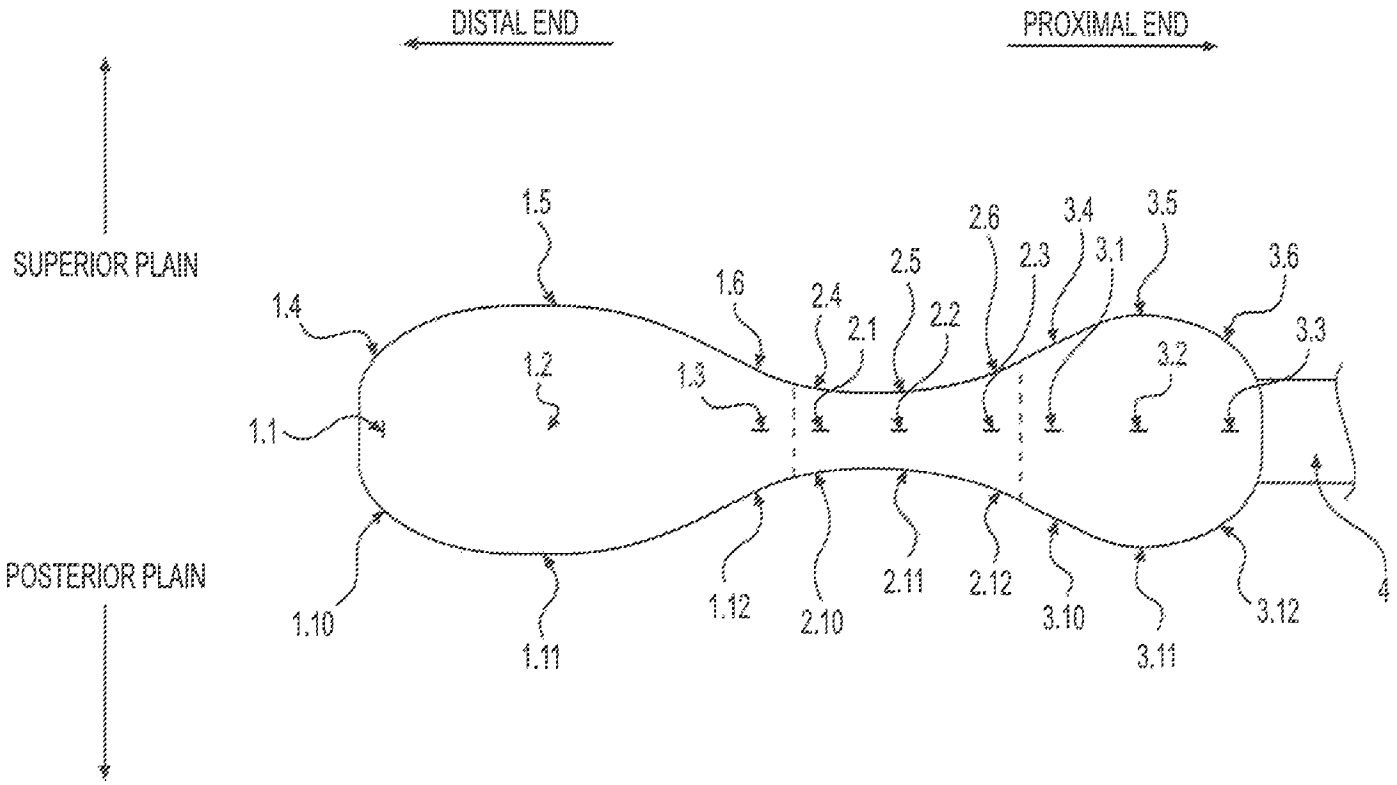
FIGS. 4A and 4B are side view schematics of embodiments of a pinch grip toothbrush handle.

FIG. 4A depicts the pinch grip handle embodiment shown in FIG. 3 viewed from the side, such that the brush head (not shown) is at the proximal end and extending in the superior plane direction. The embodiment features a distal region, a medial region, and a proximal region, as described above and in further detail below. Generally, this embodiment shows that the medial portion has a width from superior side to posterior side (e.g., 2.5 to 2.11) that is less than the width from left side to right side at the same axial position (e.g., 2.2 to 2.8). In embodiments featuring this rectangular or ovular cross section, the reduced width may be used to encourage finger and thumb contact against the finger grooves along the superior and posterior surfaces, as opposed to finger grooves along the left and right sides. Further, the natural contact surfaces created in such embodiments encourages the use of a pinch grip.

In the embodiments shown in FIGS. 3 and 4A, Surface 1.10 is the most distal portion on the posterior plane of the distal region, and in some embodiments may be tapered toward distal end 1.4. Surface 1.11 is the most medial portion on the posterior plane of the distal region. Surface 1.12 is the most proximal portion on the posterior plane of the distal region, and in some embodiments may taper toward the medial region. Surface 2.10 is the most distal portion on the posterior plane of the medial region, and in some embodiments may taper toward Surface 2.11. Surface 2.11 is the most medial portion on the posterior plane of the medial region. Surface 2.12 is the most proximal portion on the posterior plane of the medial region, and in some embodiments may taper toward Surface 2.11. Surface 3.10 is the most distal portion on the posterior plane of proximal region, and in some embodiments may taper toward the medial region. Surface 3.11 is the most medial portion on the posterior plane of proximal region. Surface 3.12 is the most proximal portion on the posterior plane of proximal region, and in some embodiments may taper toward the proximal end of the handle where it meets the shaft or neck 4.

The use of at least one finger groove in a pinch grip toothbrush encourages a user to employ a pinch grip. In the embodiment shown in FIGS. 3 and 4A, surface areas 1.3, 2.1, 2.2, 2.3, and 3.1 form a left side finger groove. The left side finger groove is on the substantially opposite side of a right side finger groove, which is formed by surface areas 1.9, 2.7, 2.8, 2.9, and 3.7. These finger grooves may provide sufficient surface area for a thumb (e.g., surfaces 2.8, 2.9, and 3.7), and for an index and perhaps middle finger (e.g., surfaces 2.3, 2.2, 2.1, and 1.3). The relative locations of finger grooves in other embodiments may be offset radially or longitudinally. Some embodiments may feature only one finger groove, whereas other embodiments may feature a plurality of finger grooves. As mentioned above, the medial region may have a width in one direction (e.g., superior to posterior) less than a width in a second direction (left to right) at the same axial location). In such embodiments, the finger grooves formed above and below the smaller width may be more likely to be used, because they encourage the use of a pinch grip more so than finger grooves at the larger width. For example, FIG. 2 shows a superior plane finger groove formed by surface areas 1.6, 2.4, 2.5, 2.6, and 3.4. In this embodiment, the superior plane finger groove is on the substantially opposite side of a posterior plane finger groove, which is formed by surface areas 1.12, 2.10, 2.11, 2.12, and 3.10. In other embodiments, a first finger groove may be located at a different longitudinal position along the long axis of the handle, or a different radial position, from a second finger groove. Although the finger grooves shown in FIGS. 1 and 2 have generally asymmetric arc shapes, a finger groove can have the shape of a smooth curve, be formed from one or more linear elements, or a combination of curved and linear elements.

A finger groove may be contoured, consisting of concave surface areas and optionally convex surface areas that, together, form finger grooves that may resemble a peanut or hour glass shape. A finger groove may have a symmetric curve shape, such as a U-shape or a V-shape, and the shape can be expanded. Alternatively, a finger groove may have an asymmetric curve shape with a vertex (point at which the curve changes direction), such that the vertex of the curve is closer to the distal end or the proximal end. A second finger groove can have the same asymmetric curve shape. Alternatively, the vertex of a second finger groove could be closer to either end than the first finger groove, to adjust the axis of the pinch grip as desired. It should be noted that some embodiments may have a finger groove with a curve that has a zero slope along a portion of the finger groove's length along the handle. This results in a flat region in the finger groove.

In the embodiment shown in FIGS. 3 and 4A, the width of the medial region in the superior to posterior direction is less that the width of the medial region in the left to right direction. This configuration encourages a pinch grip at superior and posterior finger grooves, but still allows the user to employ a pinch grip along the left and right finger grooves if desired. One of skill in the art would appreciate that the relative widths of the individual regions may be adjusted to encourage a pinch grip at different locations, depending on the desired ergonometric outcome. For example, the relative widths of the medial region in the embodiment shown in FIGS. 1 and 4A could be rotated about 90 degrees, to encourage a pinch grip that is roughly perpendicular to the toothbrush head.

Some embodiments feature a stress-breaker feature, such that the pinch grip handle will flex at a fulcrum region when the force applied by the user exceeds a threshold value. One of ordinary skill would understand that the threshold value can be selected as desired. However, studies have shown effective plaque removal with a brushing pressure of up to about 150 grams, which is much lighter than most individuals appreciate. Greater force can cause harm to teeth and gums, although one of ordinary skill may have reasons for selecting a higher pressure as a threshold value. As to the fulcrum region, the location of the fulcrum region may vary, but is generally located between the brush head and the general grip region. However, in some embodiments, the fulcrum region can be located within the general grip region. For example, the fulcrum region may be part of the medial region in some embodiments, and may be closer to the proximal side or the distal side. In other embodiments, the fulcrum region may be part of the proximal region, or even along the neck of the tooth brush (e.g., in a single piece, integral brush or a multi-piece brush). In other embodiments, for example, the fulcrum region may be part of both the medial and proximal regions, such that the region of flexion extends into both the medial and the proximal region.

A number of techniques may be used to create the fulcrum region. These techniques may be used independently or in various combinations. Some embodiments feature a medial region with a substantially narrow width in at least one direction perpendicular to the longitudinal axis of the pinch grip handle. For example, in the embodiment shown in FIGS. 3 and 4A, the fulcrum region may be generally in the medial region, between surfaces 2.2 and 2.3, and surfaces 2.8 and 2.9. The fulcrum region may be established by the relatively short distance between surfaces 2.4, 2.5, and 2.6, and surfaces 2.10, 2.11, and 2.12, as reflected in FIG. 4A. This relatively narrow dimension may create a flexion in the fulcrum region when the applied force exceeds the threshold value. One of ordinary skill may determine the relative dimensions of the regions to achieve a fulcrum region based on, for example, the threshold value, material hardness and/or flexibility, and overall handle length, to name a few variables, without undue experimentation. In some embodiments, the tapering between the medial portions 2.2 and 2.8 and proximal portions 2.3 and 2.9, respectively, of the medial region, can be sudden and pronounced to create a fulcrum region. For example, as shown in FIG. 3, the tapering between medial portions 2.2 and 2.8, and proximal portions 2.3 and 2.9, respectively, is more sudden and pronounced than the tapering between medial portions 2.2 and 2.8, and distal portions 2.1 and 2.7, respectively.

Some embodiments may feature a less dense or more pliable material at the desired location to create the fulcrum region. For example, the desired location may be manufactured from a slightly softer plastic than the remainder of the pinch grip handle. For instance, a thermoplastic enantiomer may be used for the fulcrum region, while a polypropylene may be used for the remainder of the pinch grip handle. As another example, a more flexible polymer or polymer blend may be used at the desired location to create the fulcrum. Some embodiments will feature a combination of techniques to form a fulcrum region at a desired location.

Some embodiments may feature a stress-breaker when the measured bristles exceeds a selected threshold. For instance, electrical and/or mechanical components may be introduced to cause flexion when the measured force at the brush head or bristles exceeds the threshold. Also, some embodiments of the pinch grip handle may incorporate a warning device to warn the user that the measured force at the brush head and/or bristles exceeds a threshold. The warning device may take the form of an audible tone, a vibration or change in vibration, a luminescent indicator, or a change in the speed of rotation (for electric brushes), as examples. Other methods of warning the user that the measured force exceeds the threshold may be employed.

Figure 4B:
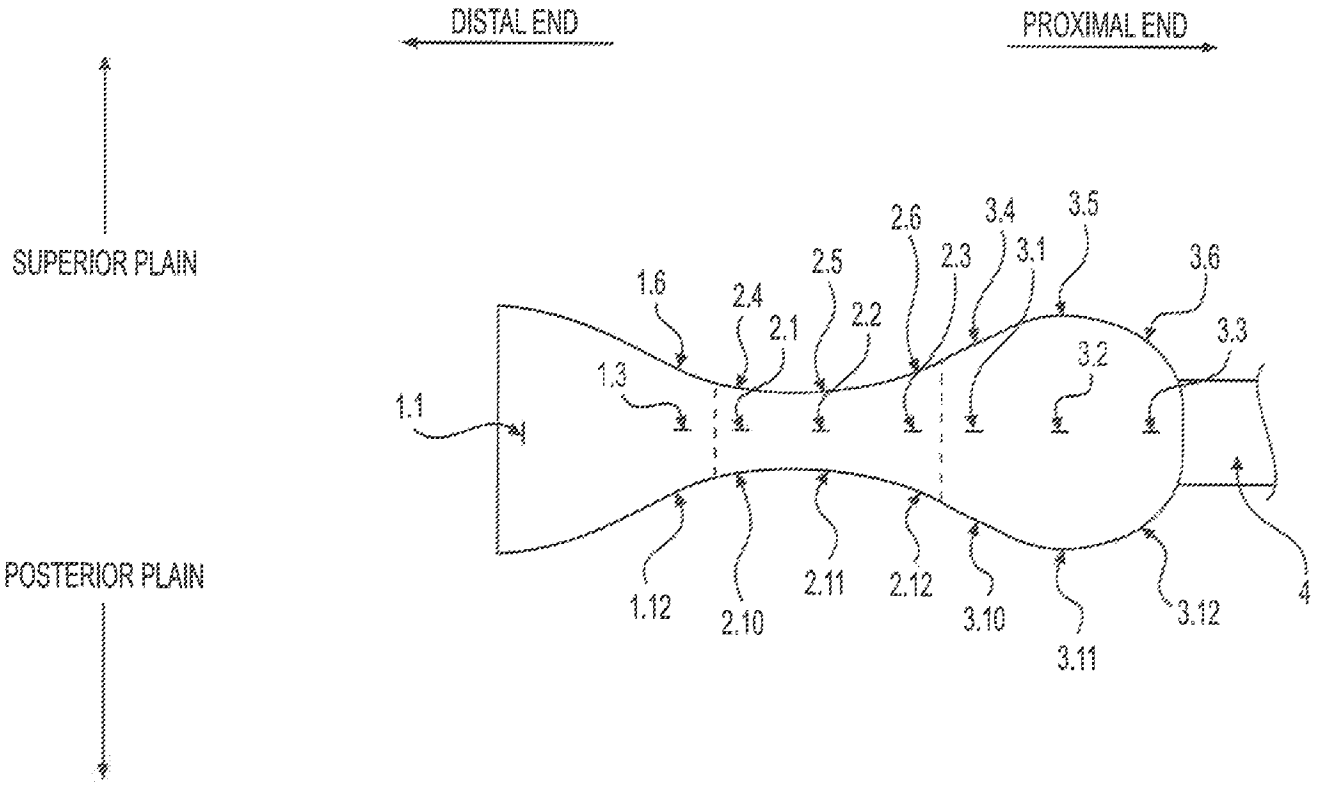

FIG. 4B shows a variant of the embodiment shown in FIGS. 1 and 4A. In FIG. 4B, the distal region is truncated to bring most distal portion 1.1 in closer proximity to most proximal portions 1.3, 1.6, 1.9, and 1.12 of the distal region. Although most distal portion 1.1 is portrayed as having a relatively flat surface in FIG. 4B, one of ordinary skill in the art would understand that the surface may be curved, and the transition between the most proximal portions and the most distal portion may be smooth, abrupt, curved, and/or tapered. Embodiments featuring a truncated distal region encourage a two-finger pinch grip, because less surface area is available for a third finger. Of course, the distal region may be configured to accommodate a third finger, such as by increasing the surface area of at least one surface of the distal region.

The individual elements of the pinch grip handle described above may be adjusted as necessary to provide a pinch grip toothbrush handle with the desired number, location, and combination of finger positions and finger grooves. The unique shape and curvature of the pinch grip toothbrush handles described herein allow a user to securely grasp and comfortably manipulate the device at a wide variety of brushing orientations, and at the same time reduce the amount of pressure the user can apply during use. In other words, a pinch grip toothbrush handle as described herein provides just enough surface area and finger positions so that a user may thoroughly and completely brush without being able to apply the same amount of potentially damaging pressure as can be done with a contemporary full-handled toothbrush.

Figure 5:
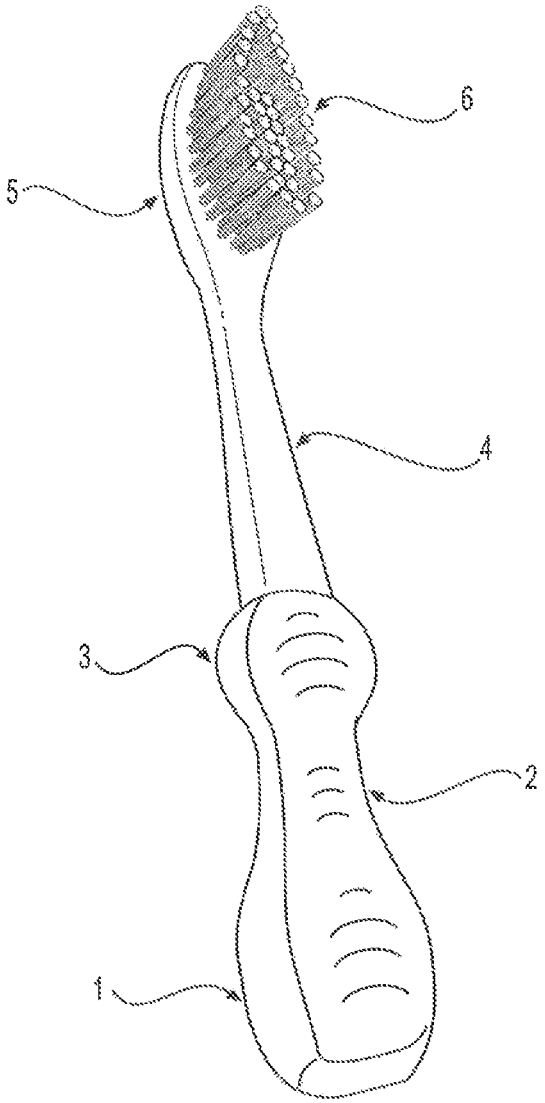
FIG. 5 is an illustration of an embodiment of a toothbrush with a pinch grip toothbrush handle.

The embodiment shown in FIG. 5 depicts the handle as a part of a single-piece toothbrush as a profile view. The dimensions of the single piece may be adjusted in order to circumferentially accommodate a two or three fingered grip, as described above. Sections 1, 2, and 3 form an pinch grip handle, comprising a distal region 1, medial region 2, and proximal region 3, of the instrument and is attached to the neck 4 at the most proximal end. Section 4 makes up the neck and is attached to the handle 1, 2, & 3 at the most distal point and the head 5 at the most proximal point. Section 5 makes up the head of the toothbrush and at its' most distal end is attached to the neck 4. A plurality of bristles 6 may be attached to the surface of head 5.

Figure 6A:
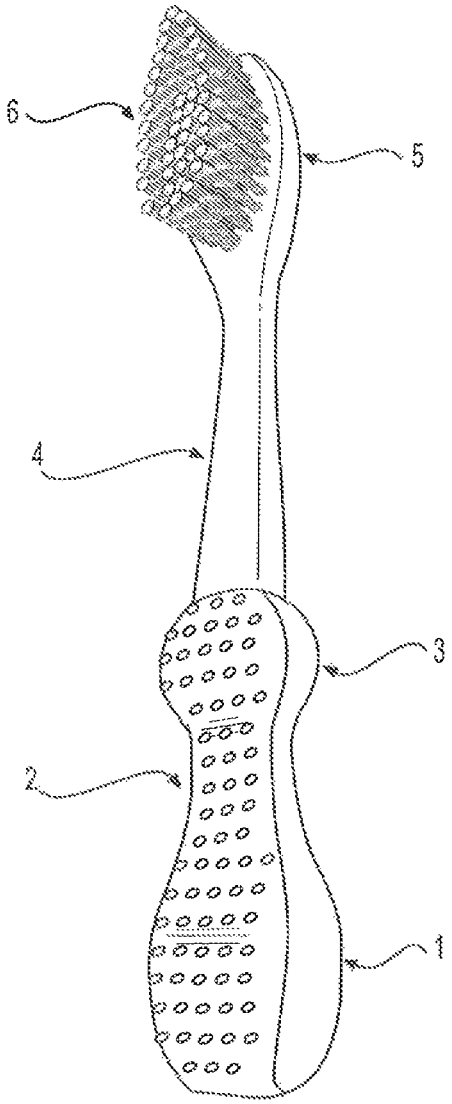
FIG. 6A is an illustration of another embodiment of a toothbrush with a pinch grip toothbrush handle.
Figure 6B:
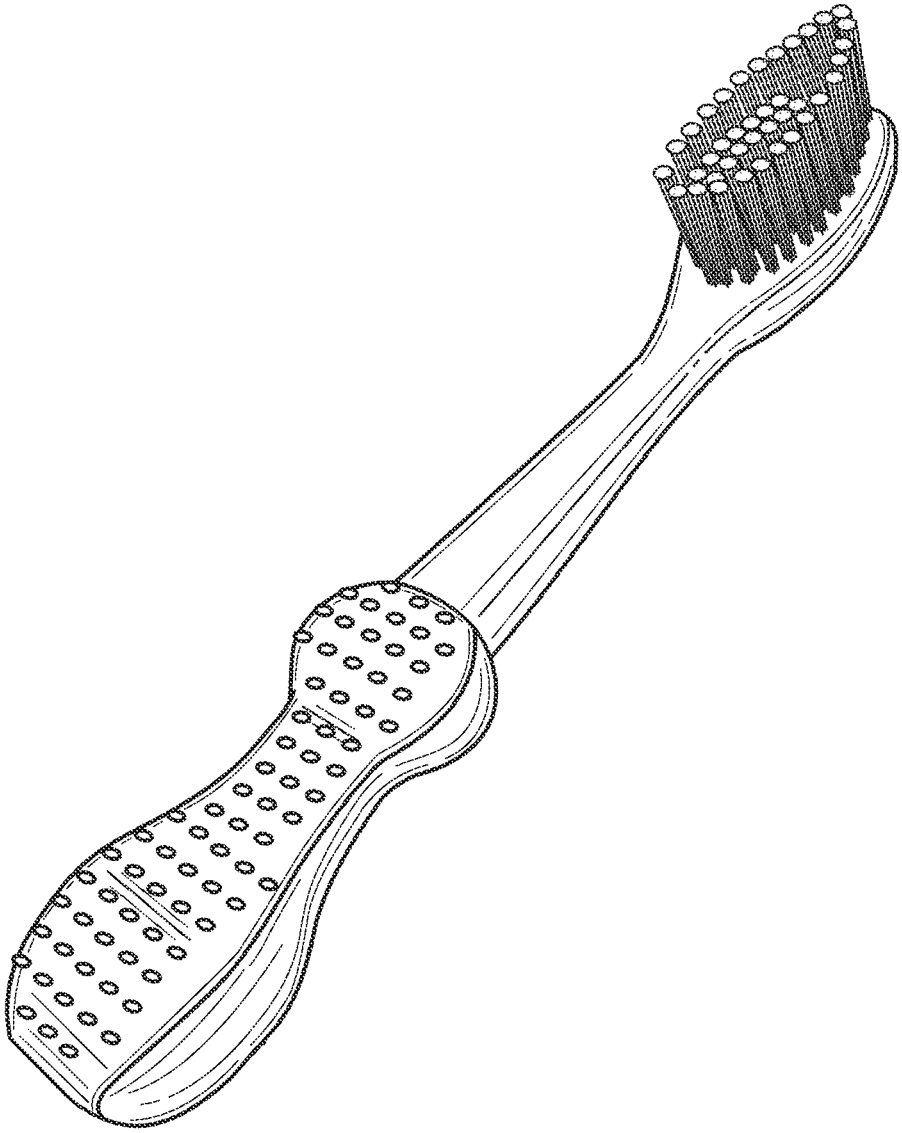
FIG. 6B is a three-dimensional rendering of another embodiment of a toothbrush with a pinch grip toothbrush handle.

FIGS. 6A and 6B show 3-dimentional representations of an embodiment of the present approach, in the form of a single piece toothbrush. The embodiment shown in FIGS. 6A and 6B has a pinch grip handle 1, 2, 3 that is approximately the same length as the neck 4 and head 5. However, the length of the pinch grip handle may be independent of the length of the neck and head. In some embodiments, the pinch grip handle length is determined by the combined lengths of the distal, medial, and proximal portions.

It should be appreciated that one skilled in the art may use average hand sizes for a target user to determine suitable configurations and sizes for a pinch grip handle toothbrush. For instance, the average length and width of an adult male hand is about 18.9 cm and 8.4 cm, respectively, and the average length and width of an adult female hand is about 17.2 cm and 7.4 cm, respectively. These average sizes may be used to determine pinch grip handle configurations for the average adult population.

For example, in some embodiments for adults, the longitudinal length of the proximal region is about one-fifth to one-fourth of the length of the pinch grip handle; the length of the medial region is about one-fifth to one-fourth of the pinch grip handle, and the length of the distal region is about one-half to three-fifths of the handle. Expressed differently, the relative lengths of the proximal, medial, and distal regions may be, as an example, about 1.0:1.0:2.5, respectively, to about 1.5:1.5:2, respectively. For example, in one embodiment suited for the average adult hand size, the pinch grip handle length may be between 4.5 cm and 5.0 cm. The proximal region length may be about 1.0 cm to 1.5 cm. The medial portion length may be about 1.0 cm to 1.5 cm. The distal portion length may be between 2 cm and 2.5 cm. In some embodiments, the relative lengths may be about 1.5:1.0:3.0, but may vary by about 0.1 to 1.0. The overall length of some embodiments of the pinch grip handle may be about 3 cm to about 6 cm, and more preferably between 4 cm and 5 cm, and even more preferably about 4.5 cm. Research indicates that these lengths are especially suited for use by a wide range of adult hand sizes, male and female, and that the relative lengths provide superior encouragement for using a pinch grip. Research indicates that these ranges provide sufficient surface area for encouraging a pinch grip and providing enough control for most adult hand sizes, without encouraging the use of a power grip. In other words, these ranges enable embodiments to take advantage of the full range of benefits provided by the present approach. Shorter handles may not provide sufficient surface area for a pinch grip, whereas longer handles may provide so much additional surface area that a user may be inclined to employ a power grip (unless, as described below, the distal region is adequately large enough to discourage a power grip).

As reflected in these demonstrative examples, the distal region is in some embodiments, but not necessarily all, longer than either of the other regions. In such embodiments, the longer distal region provides for better control of the toothbrush, especially in a pinch grip, as well as a studier grip. It also allows increased surface area for the placement of a second finger in the pinch grip, and in embodiments in which the handle extends beyond the distal region (see, e.g., FIG. 10A), may be used to discourage the use of a power grip. In other embodiments, the relative sizes of the proximal portion and the distal portion may be reversed, such that the longer proximal portion provides added grip surface, control improvement, and improved grip. Some embodiments may feature sufficient surface area on the distal region for a second finger, even if the length of the distal region is less than the length of the proximal region. Of course, these dimensions, relative dimensions, and geometries are provided as mere demonstrative examples of embodiments, and should not be understood as limiting the claims appended hereto.

Another method for determining the dimensions of a pinch grip handle is to determine the target user's anatomical considerations. The size and shape of an individual's fingers can vary significantly, and depend on factors such as the individual's gender, height, weight, and genetics. It may be desirable to configure a pinch grip toothbrush handle to accommodate a target user class (for, as an example, a targeted marketing campaign), such as 3-5 year old children, or adult males between 30-40 years of age. Data may be used to determine average finger and thumb dimensions are shapes for the target class. As one example, a finger groove as described herein can be designed to accommodate a specific finger size, e.g., a finger groove may be designed to fit around a desired portion of the circumference of a user's distal phalanx. If the circumference of a user's index finger distal phalanx is, as an example, 3 cm, then a finger groove may be designed to have a length of 1.5 cm (i.e., half of the circumference) using basic geometry. In this example, the finger groove also accommodate another user's finger having a 4 cm circumference, but at a smaller portion of the overall circumference. The same approach may be used to determine the optimum shape of a finger groove for a target user class. For example, the finger groove may be symmetric for one class of users (e.g., for a class that includes left-handed and right-handed users), or asymmetric as desired. In this way, average finger and thumb circumference data for target users may be used to determine the optimum finger groove length and shape to meet the largest fraction of users. Similarly, data can be used to determine the shape, size, and placement of additional finger grooves on the pinch grip handle. For example, the data for the target class of users may suggest that two finger grooves, positioned at opposite radial locations on the pinch grip handle (e.g., 3 o'clock and 9 o'clock), and having matching asymmetric shapes, is appropriate for the target class. Similarly, data may also be used to determine the optimum overall length of the pinch grip handle. For example, the optimum length of a pinch grip handle for a target user class of 3-5 year old children may be shorter than the optimum length of a pinch grip handle for a target user class of 30-40 year old adult males. One of ordinary skill would appreciate that one or more finger grooves, and/or the shape and length of the pinch grip handle, can be designed to accommodate target users or desired ranges of finger and thumb sizes and shapes.

FIGS. 7 and 8 show other embodiments of a toothbrush handle that encourages the use of a pinch grip, may be adjusted to accommodate a 2 or 3 fingered grip and facilitates healthier brushing technique by-way-of the grip.

Figure 7A:
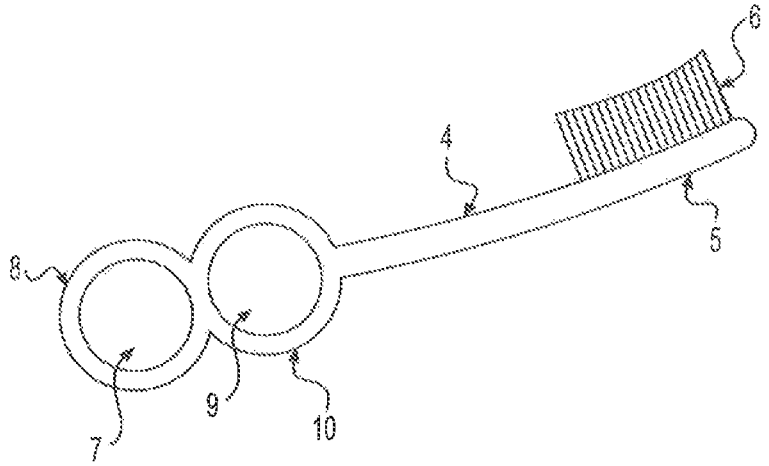
FIGS. 7A-7C show embodiments of toothbrushes that encourage the use of a pinch grip.
Figure 7B:
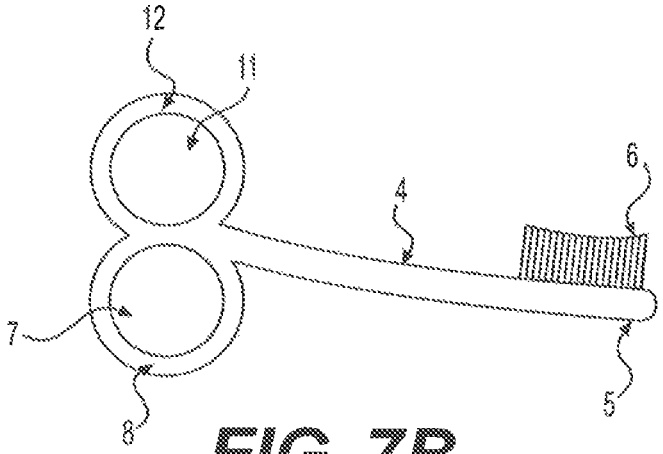
Figure 7C:
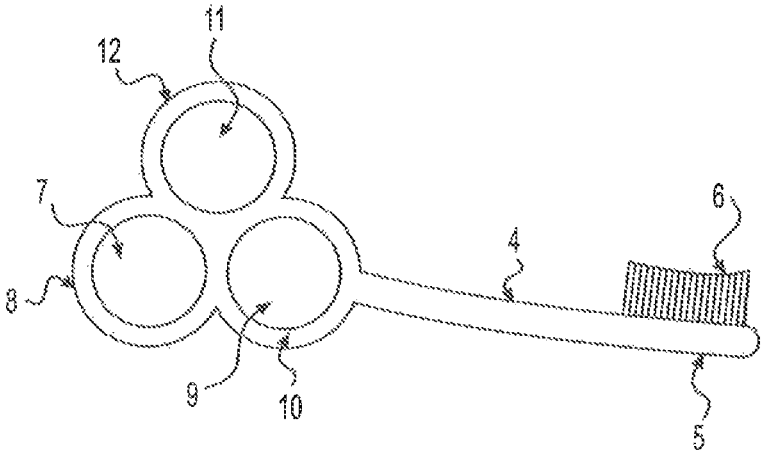

FIGS. 7A-7C depict an embodiment with a pinch grip handle having rings to accommodate a two or three fingered pinch grip. Holes 7, 9, & 11 are holes within the corresponding rings 8, 10, & 12 which allow for a finger to pass through. These rings may be arranged in multiple combinations. Although the rings 8, 10, 12 are shown as having circular holes, the shape of the holes may be any shape suitable to accept a finger, and provide sufficient surface area for an effective pinch grip.

Figure 8A:
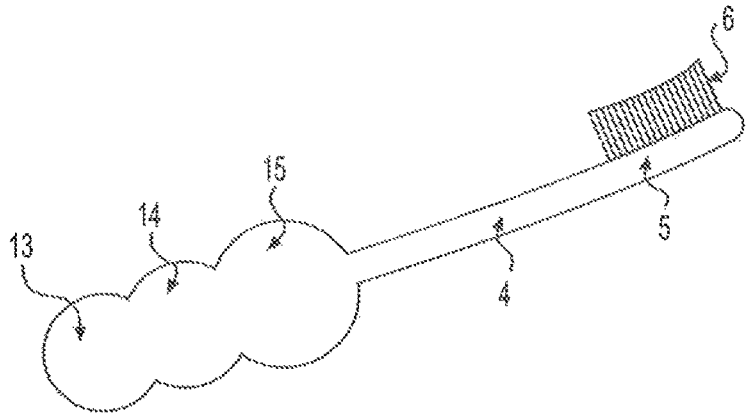
FIGS. 8A-8D show embodiments of toothbrushes that encourage the use of a pinch grip.
Figure 8B:
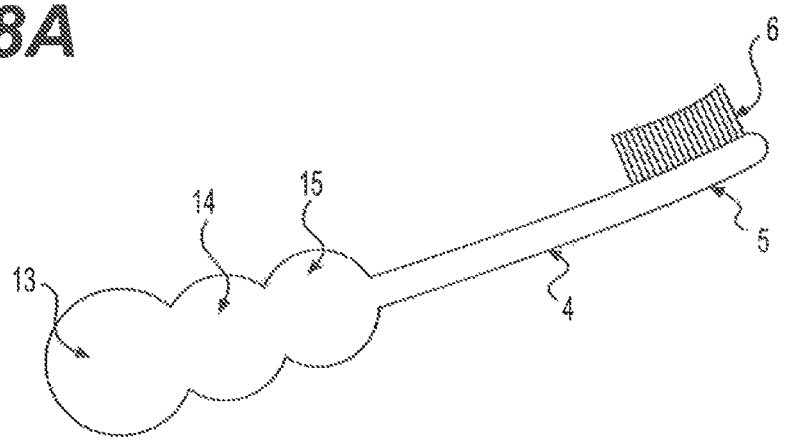
Figure 8C:
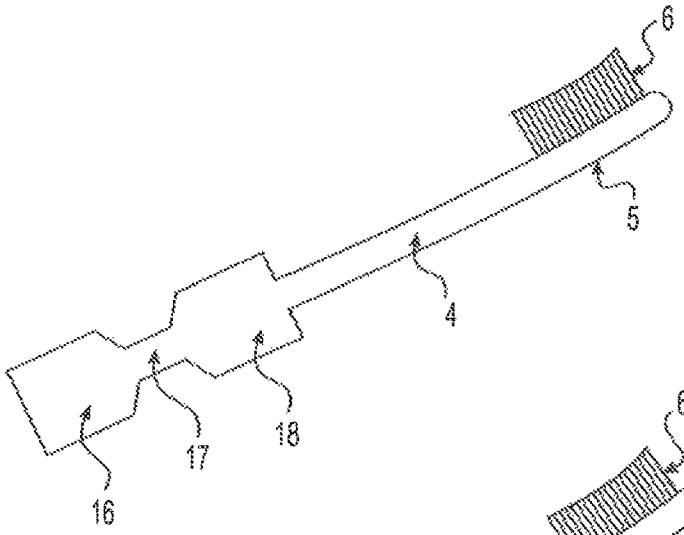
Figure 8D:
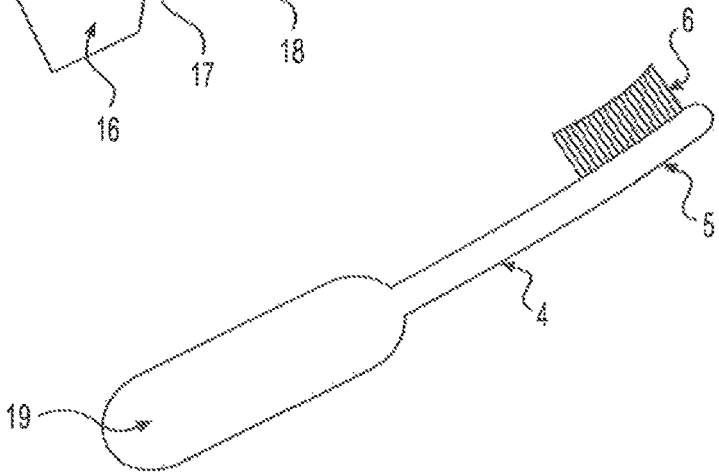

FIGS. 8A-8D show alternative embodiments of pinch grip handles with an assortment of surface configurations. Regions 13, 14, and 15 in FIGS. 8A and 8B are representations of sphere-like areas that connect to make a handle designed to circumferentially accommodate a 2 or 3 fingered grip. The individual regions combine to form multiple areas that can serve as finger grooves. In FIG. 8C, regions 16, 17, and 18 are each unique areas of a whole handle, having angular surfaces designed to circumferentially accommodate a 2 or 3 fingered grip. The highly angular finger grooves in this embodiment are shown at the superior and posterior surfaces, and may be sized to encourage a tip pinch type of grip. In FIG. 8D, handle 19 is a cylindrical shaped handle designed to circumferentially accommodate a 2 or 3 fingered grip. The length of the handles shown in FIGS. 8A-8D is such that it encourages the user to employ a pinch grip.

Figure 9A:
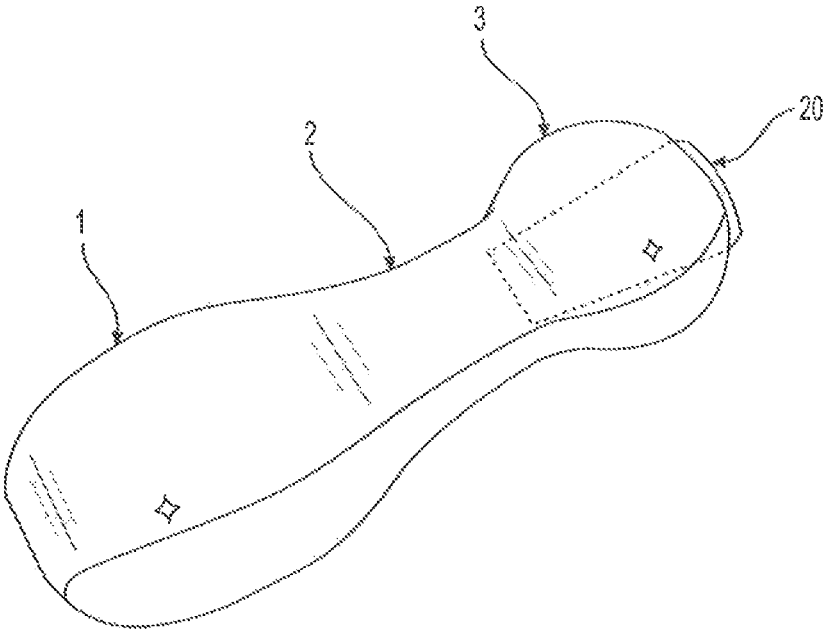
FIGS. 9A-9D illustrate embodiments of pinch grip handles having various connection features.
Figure 9B:
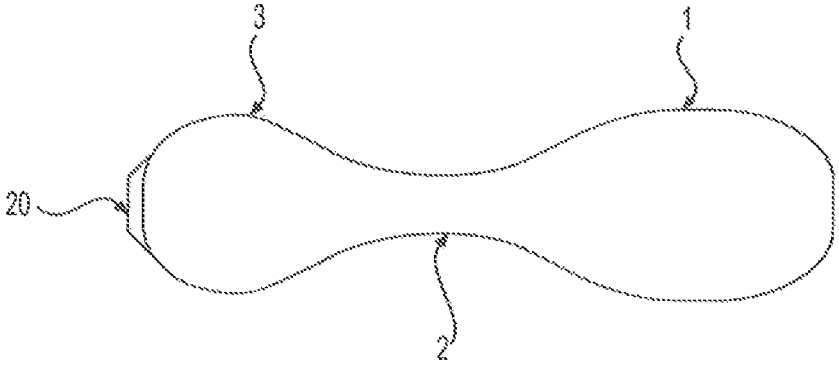

FIGS. 9A and 9B depicts a pinch grip handle configured for use with a separate or supplemental attachment to an already existing toothbrush or toothbrush head. Section 20 is the most proximal point of the handle and is the attachment and or insertion point. Section 20 may be configured to receive and/or attach to an already existing toothbrush or toothbrush head. The attachment may be via tight insertion, snap-fit, screwed on, or any other means for connecting separate toothbrush to pinch grip handle. Region 20 may also include space for other components, such as mechanical and/or electrical components for an oscillating or rotating toothbrush or toothbrush head, and also to include space for one or more batteries to power the apparatus. The distal end may also feature elements to permit the components to charge, as is known in the art. Alternatively, the pinch grip handle may feature spaces for charging contacts to protrude through the pinch grip handle and contact a charging element.

Figure 9D:
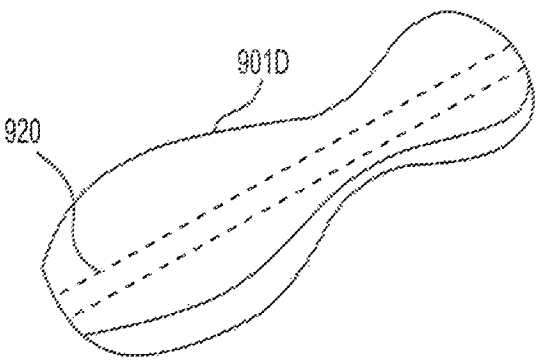
Figure 9D:
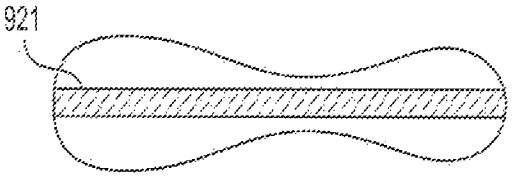
Figure 9C:
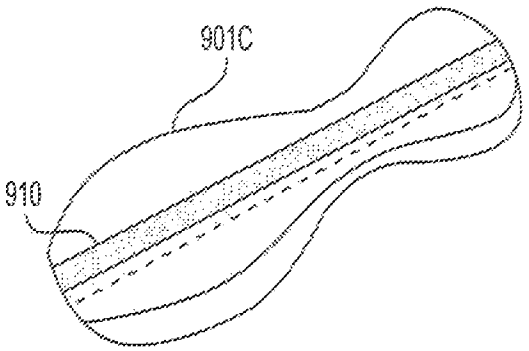
Figure 9C:
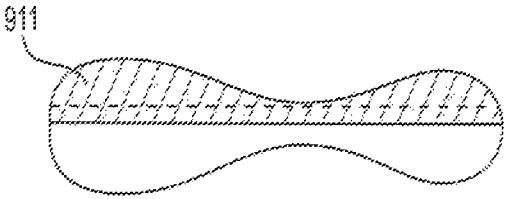

Some embodiments of the pinch grip handle may be configured for attachment to a toothbrush shaft. FIGS. 9C and 9D show embodiments of pinch grip handles that may be attached to a toothbrush. The top view is a perspective view of the superior and side surfaces, and the bottom view is a side sectional view. For example, the embodiment handle 901*c* shown in FIG. 9C includes a groove 910, along the long axis of the handle 901*c*, and on the superior (top) side. The shaft 910 may extend to a depth such that an inner surface 911 provides adequate contact area for a toothbrush shaft (not shown) to be inserted into groove 910, for attaching pinch grip handle 901*c* to a toothbrush. Although groove 910 is generally linear, it should be appreciated that other embodiments may feature differently shaped grooves to correspond to a toothbrush shaft.

FIG. 9D shows an embodiment handle 901D that includes a hollow bore 920, through which a toothbrush shaft (not shown) may be inserted into the bore 920 to connect handle 901*d* to a toothbrush. It should be appreciated that the bore 920 may be configured to correspond to the shape of a shaft. It should also be appreciated that the embodiments shown in FIGS. 9A-9D may include other mechanisms to lock the handle in place, such as structural elements including, for example, a boss, a compression sleeve, a threaded element, and the like.

Figure 10A:
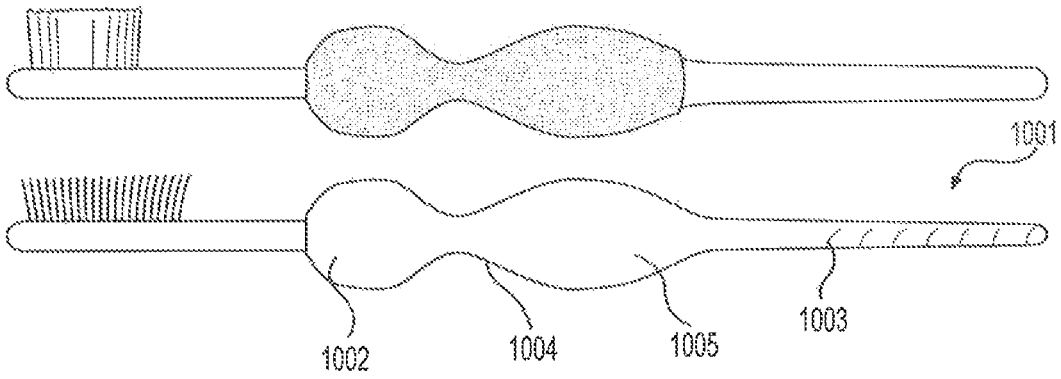
FIGS. 10A and 10B show embodiments of a pinch grip handle toothbrush with a tail extension from the distal region.
Figure 10B:
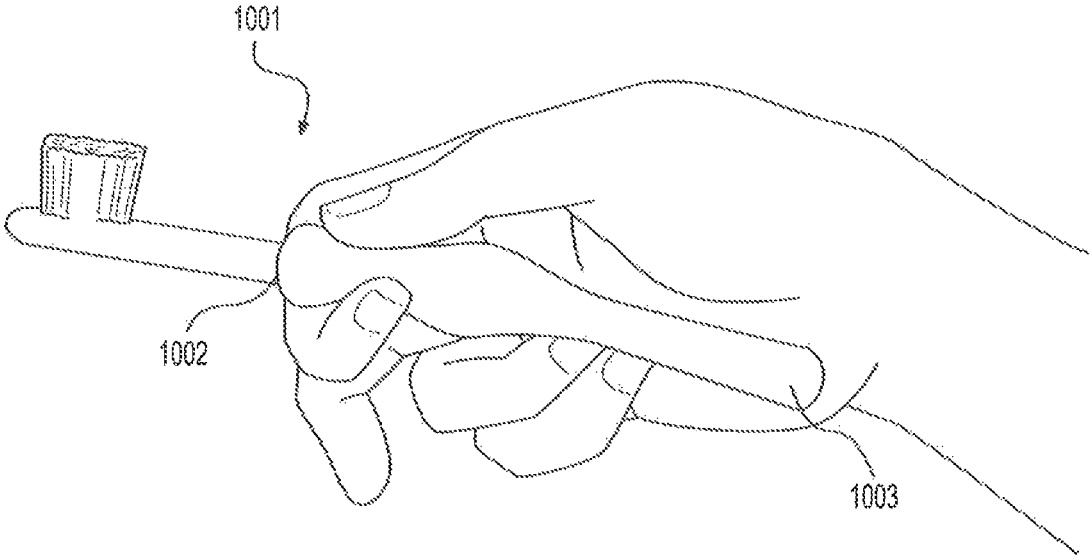

As mentioned above, some embodiments may include a handle portion extending beyond the distal region of the pinch grip handle. For example, the toothbrush shaft used with a handle in FIG. 9C or 9D may extend several centimeters beyond the distal region. FIGS. 10A and 10B show embodiments in which a single piece includes a pinch grip handle having a handle extension. In FIG. 10A, toothbrush 1001 includes a proximal region 1002, a medial region 1004, a distal region 1005, and a tail portion 1003 extending beyond the distal region 1005. As a result, the length of toothbrush 1001 may more closely resemble the length of contemporary toothbrushes. In such embodiments, the pinch grip handle (e.g., proximal region 1002, medial region 1004, and distal region 1005) may be configured to encourage a pinch grip, even though the toothbrush 1001 includes additional surface area that may normally encourage a power grip. The relative width of distal region 1005 from superior side to posterior side may be increased to make a power grip feel less comfortable than a pinch grip. Additionally, the length of distal region 1005 from proximal end to distal end may be increased for the same purpose. As a result, the pinch grip handle encourages the user to use a pinch grip, as shown in FIG. OB. Although the additional fingers may have a tendency to position near the tail portion 1003, the pinch grip handle's configuration encourages the index finger and the thumb to form a pinch grip, thereby significantly reducing the pressure the user may impart against the gums during brushing.

It should be understood, of course, that the foregoing relates to exemplary embodiments of the invention and that modifications may be made without departing from the spirit and scope of the invention as set forth in the following claims.

What is claimed is:

1. A toothbrush having a pinch grip handle, the pinch grip handle comprising:

a distal region having a first distal end, a first medial portion, and a first proximal end;

a medial region having a second distal end, a second medial portion, and a second proximal end; and a proximal region having a third distal end, a third medial portion, and a third proximal end;

the second distal end connected to the first proximal end, the third distal end connected to the second proximal end, and the third proximal end connected to a neck having a head and a plurality of bristles;

wherein the pinch grip handle has a tapered radial width in a first direction along the first proximal end, second distal end, second medial portion, second proximal end, and third distal end, the radial width in the first direction tapering such that the radial width in the first direction decreases from the first proximal end to the second medial portion and increases from the second medial portion to the third distal end;

wherein the tapered width defines a first finger groove along a first surface area of the pinch grip handle and a second finger groove along a second surface area of the pinch grip handle opposite the first surface in the first direction, the first finger groove and the second finger groove encouraging the use of a pinch grip on the pinch grip handle; and wherein the pinch grip handle has a tapered radial width in a second direction perpendicular to the first direction and a long axis of the toothbrush, along the first proximal end, second distal end, and second medial portion, second proximal end, and third distal end, the radial width in the second direction tapering such that the radial width in the second direction decreases from the first proximal end to the second medial portion and increases from the second medial portion to the third distal end.

2. The toothbrush of claim 1, wherein the radial width in the second direction is greater than the radial width in the first direction at at least one of the second distal end, second medial portion, second proximal end.

3. The toothbrush of claim 1, wherein the pinch grip handle further comprises a fulcrum region about which the pinch grip handle flexes when an applied force exceeds a threshold value, the fulcrum region in at least one of (i) at least a portion of the medial region and (ii) at least a portion of the proximal region.

4. The toothbrush of claim 1, wherein the pinch grip handle has a handle length from the first distal end to the third proximal end of between 3 cm and 6 cm.

5. The toothbrush of claim 1, wherein the distal region is truncated, defining a flat surface in a plane perpendicular to a long axis of the toothbrush.

6. The toothbrush of claim 1, wherein at least one of the distal region, the medial region, and the proximal region, comprises a textured surface.

7. The toothbrush of claim 1, wherein at least one of the first finger groove and the second finger groove comprises a textured surface.

8. The toothbrush of claim 1, wherein the pinch grip handle has a handle length, and the proximal region has a longitudinal length about one-fifth to one-fourth of the handle length.

9. The toothbrush of claim 1, wherein the pinch grip handle has a handle length, and the medial region has a longitudinal length about one-fifth to one-fourth of the handle length.

10. The toothbrush of claim 1, wherein the pinch grip handle has a handle length, and the distal region has a longitudinal length about one-half to three-fifths of the handle length.

11. The toothbrush of claim 1, wherein the pinch grip handle is releasably coupled to the neck.

12. A toothbrush having a pinch grip handle, the pinch grip handle comprising:

a distal region having a first distal end, a first medial portion, and a first proximal end;

a medial region having a second distal end, a second medial portion, and a second proximal end; and a proximal region having a third distal end, a third medial portion, and a third proximal end;

the second distal end connected to the first proximal end, the third distal end connected to the second proximal end, and the third proximal end connected to the neck;

wherein the pinch grip handle has a tapered radial width in a first direction along the first proximal end, second distal end, second medial portion, second proximal end, an third distal end, the radial width in the first direction tapering such that the radial width in the first direction decreases from the first proximal end to the second medial portion and increases from the second medial portion to the third distal end;

wherein the tapered width defines a first finger groove along a first surface area of the pinch grip handle and a second finger groove along a second surface area of the pinch grip handle opposite the first surface in the first direction, the first finger groove and the second finger groove symmetrical along a long axis of the toothbrush and encouraging the use of a pinch grip on the pinch grip handle; and wherein the pinch grip handle has a tapered radial width in a second direction perpendicular to the first direction and a long axis of the toothbrush, along the first proximal end, second distal end, second medial portion, second proximal end, and third distal end, the radial width in the second direction tapering such that the radial width in the second direction decreases from the first proximal end to the second medial portion and increases from the second medial portion to the third distal end.

13. The toothbrush of claim 12, wherein the radial width in the second direction is greater than the radial width in the first direction at at least one of the second distal end, second medial portion, second proximal end.

14. The toothbrush of claim 12, wherein the pinch grip handle further comprises a fulcrum region about which the pinch grip handle flexes when an applied force exceeds a threshold value, the fulcrum region in at least one of (i) at least a portion of the medial region and (ii) at least a portion of the proximal region.

15. The toothbrush of claim 12, wherein the pinch grip handle has a handle length from the first distal end to the third proximal end of between 3 cm and 6 cm.

16. The toothbrush of claim 12, wherein at least one of the first finger groove and the second finger groove comprises a textured surface.

17. The toothbrush of claim 12, wherein the pinch grip handle is releasably coupled to the neck.

* * * * *